US006431512B1

(12) United States Patent
Fox et al.

(10) Patent No.: US 6,431,512 B1
(45) Date of Patent: Aug. 13, 2002

(54) INSTRUCTION CARD ASSEMBLY FOR COMPUTER KEYBOARD SUPPORT

(75) Inventors: Marc W. Fox; Anthony McConnell, both of Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/589,473

(22) Filed: Jun. 7, 2000

(51) Int. Cl.[7] ..... E04G 3/00

(52) U.S. Cl. ..... 248/286.1; 248/220.22; 248/918; 40/727; 108/50.02; 312/234

(58) Field of Search ..... 248/286.1, 917, 248/918, 921, 220.22; 312/234, 234.1, 234.2, 234.4, 234.5, 208.1, 223.3; 108/50.02, 138; 40/727, 649

(56) References Cited

U.S. PATENT DOCUMENTS

| | | | | |
|---|---|---|---|---|
| 1,180,750 A | * | 4/1916 | Wolf | 312/231 |
| 1,465,244 A | * | 8/1923 | Hager | 40/375 |
| 2,064,749 A | | 12/1936 | Huber | |
| 2,131,586 A | | 9/1938 | Dano | |
| 2,545,262 A | | 3/1951 | Coleman | |
| 3,991,495 A | | 11/1976 | Wilson | |
| 4,715,652 A | | 12/1987 | Ward | |
| 5,586,806 A | * | 12/1996 | Hergott | 297/188.11 |
| 5,700,051 A | | 12/1997 | Newhouse | |
| 5,836,560 A | | 11/1998 | Kaplan et al. | |
| 5,975,474 A | | 11/1999 | Kaplan et al. | |
| 5,997,080 A | | 12/1999 | Newhouse et al. | |
| 6,058,638 A | * | 5/2000 | Slattebrekk | 40/654.01 |
| RE36,928 E | | 10/2000 | Newhouse et al. | |
| 6,227,615 B1 | * | 8/2001 | Newhouse et al. | 297/188.11 |

FOREIGN PATENT DOCUMENTS

| | | |
|---|---|---|
| CH | 154972 | 8/1932 |

OTHER PUBLICATIONS

Ergonomics News, vol. 3, No. 1, Jan./Feb. 1997, one–page advertisement.
Figures 1 and 2 and Photos A and B of prior art instruction card for keyboard support.
Figures 1A, 2A, 3A and 4A and Photos C, D and E of prior art instruction card for chair.
Photo F of prior art keyboard support with instructional information applied to arm.
HÅG CREDO Collection Brochure, date unknown, 14 pages.
HÅG SIGNÉT Collection Brochure, date unknown, 12 pages.
HÅG Digest, Jun. 1993 Special Neocon Edition, 4 pages.
HÅG web pages, "Introducing the HÅAG H105 Best of Neocon Gold Award", http://haginc.com/products/h05.htm, Mar. 16, 2001, 2 pages.

* cited by examiner

*Primary Examiner*—Kimberly T. Wood
(74) *Attorney, Agent, or Firm*—Flynn, Thiel, Boutell & Tanis, P.C.

(57) ABSTRACT

An instruction card assembly which includes a spacer plate and a card including printed or pictorial instructional information thereon. The spacer plate is sandwiched between the underside of a worksurface and an elongate track utilized for slidably mounting an arm assembly of a keyboard pad arrangement such that a sidewardly opening recess is defined. The card is disposed in this recess and is slidably movable between a retracted storage position wherein the card is positioned substantially beneath the worksurface and an extended use position for displaying operational instructions for reference by a user.

20 Claims, 5 Drawing Sheets

INSTRUCTION CARD ASSEMBLY FOR COMPUTER KEYBOARD SUPPORT

FIELD OF THE INVENTION

This invention relates to an instruction card assembly which may be utilized in conjunction with a computer keyboard support, and more particularly, to an improved instruction card assembly which slidably mounts an instruction card including pictorial and/or printed information adjacent the edge of a worksurface to which the keyboard support is connected.

BACKGROUND OF THE INVENTION

Instructional-type information is typically affixed to office accessories in a location which enables easy visual access to instructions necessary for correct operation of the product. This type of display of instructional information thus eliminates the need for constant reference to an instruction manual during use of a product, which permits the user to quickly make operational adjustments to the product and thus can increase overall efficiency in the workplace.

One type of product in which the display of instructional information in close proximity to the product is particularly useful is a computer keyboard support. Keyboard supports are typically supported from a worksurface by an arm structure which permits adjustment of the vertical height and/or the tilt of the keyboard support in relation to the worksurface for the comfort of the individual user. The adjustment mechanisms or actuators for adjusting the position of the keyboard supports vary, and readily accessible instructions are desirable to allow the user to quickly adjust the keyboard support to the appropriate position which promotes efficiency and correct and safe operation of the product by the user.

One method of displaying instructional information in relation to a keyboard support is to provide same on the upper surface of the arm which interconnects the support to the worksurface or table top. This is done by providing the instructional information on a self-adhesive label which is then applied to the upwardly facing surface of the arm, or by applying the instructional information to the arm by a silk-screening process. The above method is advantageous in that the instructions are visible to the user essentially at all times due to the location thereof. However, the instructional labels or decals often deteriorate and become soiled easily since same are exposed.

Another method of providing instructions for operation of a keyboard support arrangement is to mount an instruction card on the keyboard support so that same can be pulled out from a rear edge thereof near the back of the keyboard. This instruction card defines a pair of elongate and parallel slots therein which permit mounting of the card on a clevis or pivot bracket provided on the underside of the keyboard support which allows the support to tilt or pivot relative to the support arm. The instruction card is thus assembled to the keyboard support during mounting of the arm thereto, and the slots allow sliding of the card between a retracted or stored position substantially beneath the keyboard and an extended position for reading the instructions provided thereon. By mounting the card so that same can be moved into a stored or non-use position under the keyboard support, soiling of the card can be minimized. However, since the card is constructed of a paper or cardboard material and the pivot bracket to which same is mounted is typically constructed of metal, the repeated sliding of the card relative to the bracket can cause damage to the card such as tearing.

The above instruction card is used in association with a commercially available keyboard support product sold under the trademark STELLA, which product is similar to that disclosed in U.S. Pat. Nos. 5,975,474 and 5,836,560.

Instructional card arrangements are also utilized with office-type chairs which are adjustable in height and tilt, for example. One type of instruction card arrangement is disclosed in U.S. Pat. Nos. 5,997,080 and 5,700,051. The arrangement illustrated in the '080 and '051 patents includes a channel bracket which is mounted to the lower side of the chair, and an instruction card which is slidably supported within the bracket so that same can be extended sidewardly outwardly from the side of the chair seat. Pictorial instructional information is printed on the card in a manner such that same corresponds to the orientation of the means for adjusting the chair, that is, the adjustment features on the right side of the chair are shown on the right side of the card and vice versa. The user when seated in the chair pulls the card sidewardly from the underside of the chair seat to visually access the information thereon for adjustment of the chair.

It is an object of the invention to provide an improved instruction card assembly which is simple to operate and assemble, and particularly an instruction card assembly which is not subject to premature wearing and soiling as is the case with exposed decals or labels and is not easily damaged during use.

The invention is particularly suitable for use with a keyboard support arrangement having a support arm with the front end associated with a computer keyboard support and a rear end slidably mounted to a track fixed to the underside of a worksurface. An information card assembly is provided adjacent the rear end of the support arm and includes a spacer element clamped between an upper surface of the track and the underside of the worksurface. The spacer element defines a slot which opens outwardly, and a card having instructional information thereon is disposed within the slot for sliding movement between an extended position wherein the card is cantilevered outwardly from the slot and a retracted storage position wherein the card is positioned substantially beneath the worksurface.

The invention further relates to a support pad arrangement including a keyboard support pad for supporting a computer keyboard thereon, and an elongate channel-like track disposed at a lower surface of the worksurface and having a substantially planar top wall positioned closely adjacent the lower surface of the worksurface. An elongate support structure is provided and has one end connected to the keyboard support pad and an opposite end slidably engaged within the track for permitting movement of the keyboard support pad towards and away from the worksurface. An information card assembly is sandwiched between the top wall of the track and the lower surface of the worksurface, which assembly includes a plate-like element defining a generally horizontally extending recess therein which opens sidewardly adjacent a terminal edge portion of the worksurface. A card including instructional information is slidably disposed within this recess and is extendible outwardly therefrom for providing the user with visual access to the information thereon.

The invention relates to an assembly for displaying instructional-type information for mounting to a worksurface, the assembly including a lower plate-like member and an upper plate-like member having a generally U-shaped end defined by an inner edge portion and a pair of spaced apart arms which are cantilevered from the inner edge portion. The upper and lower plate-like members are fixed to the worksurface with the upper plate-like member or spacer being sandwiched between the lower plate-like member and the lower surface of the worksurface. The assembly further includes a slot defined by the lower surface of the worksurface, an upwardly facing side of the lower plate-like member, and the arms and the inner edge portion of the upper plate-like member, with the slot opening sidewardly adjacent the edge portion of the worksurface. A card is also provided and has instructional information thereon, the card being slidably disposed within the slot for movement between a retracted storage position wherein the card is disposed substantially beneath the worksurface and an extended use position for providing visual access to the instructional information thereon.

Other objects and purposes of the invention will be apparent upon reading the following specification and inspecting the accompanying drawings.

Figure 1:
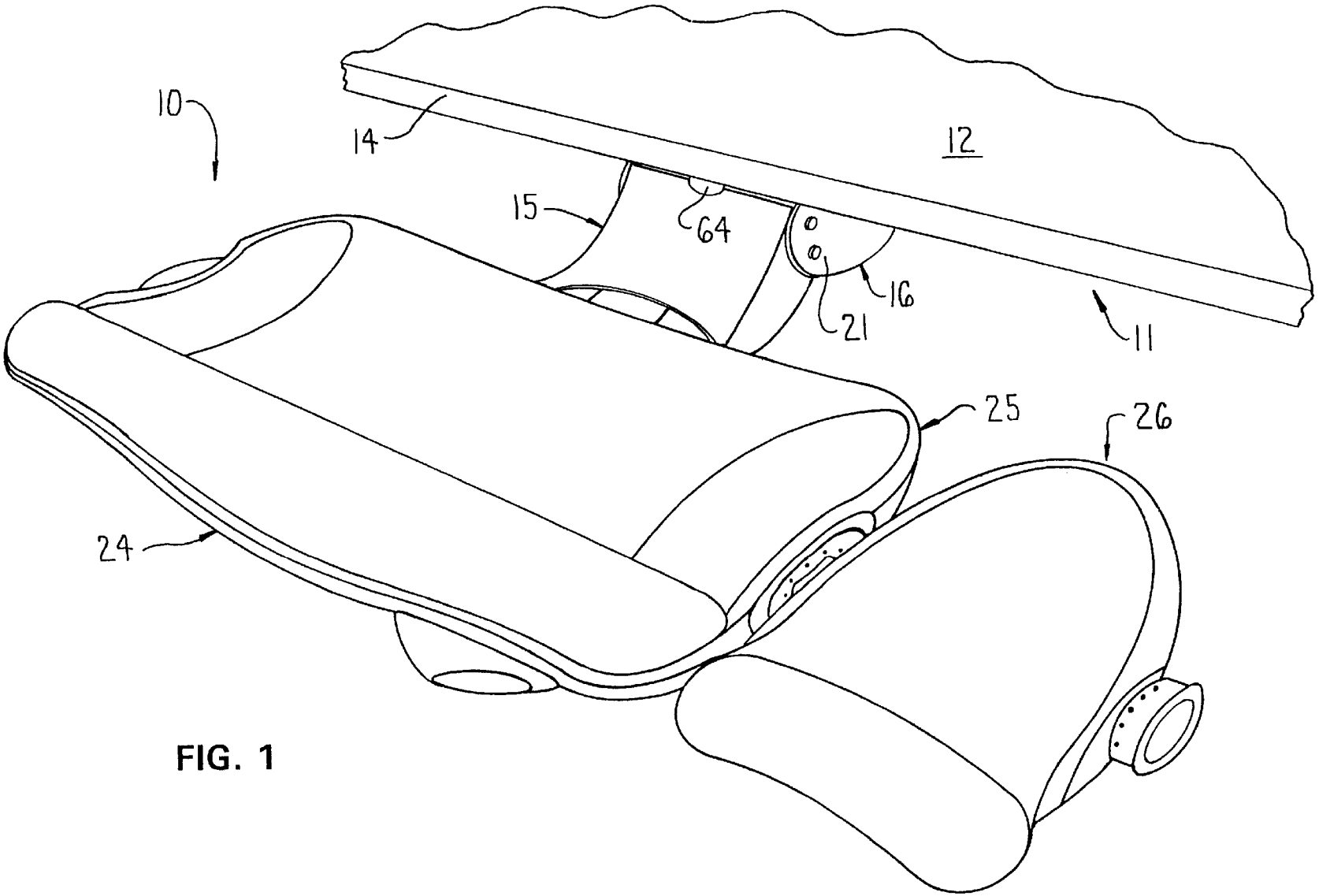
FIG. 1 is a perspective view which illustrates a keyboard support arrangement attached to a conventional worksurface, with the instruction card assembly according to the invention mounted adjacent the edge of the worksurface and illustrated in the retracted storage position.

Certain terminology will be used in the following description for convenience in reference only, and will not be limiting. For example, the words "upwardly", "downwardly", "rightwardly" and "leftwardly" will refer to directions in the drawings to which reference is made. The word "forwardly" will be used in conjunction with the portions of the keyboard arrangement and instruction card assembly positioned closest to the user, and similarly the word "rearwardly" will refer to portions of the keyboard arrangement and instruction card assembly positioned remote from the user. The words "inwardly" and "outwardly" will refer to directions toward and away from, respectively, the geometric center of the overall arrangement and designated parts thereof. Said terminology will include the words specifically mentioned, derivatives thereof, and words of similar import.

DETAILED DESCRIPTION

Figure 2:
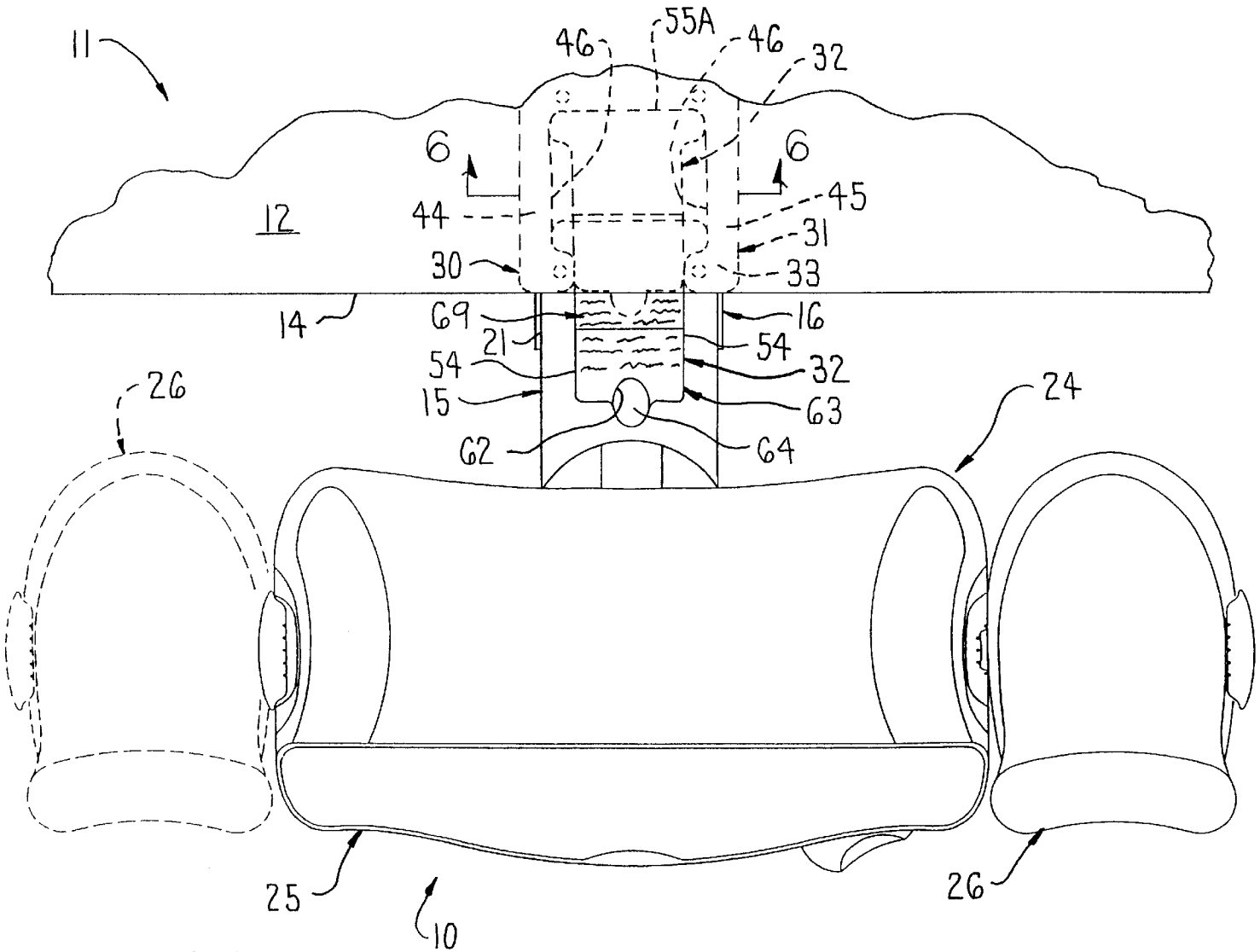
FIG. 2 is a top view which illustrates the keyboard support arrangement and the instruction card in the extended use position, with the retracted storage position of the instruction card being illustrated in dotted lines.
Figure 3:
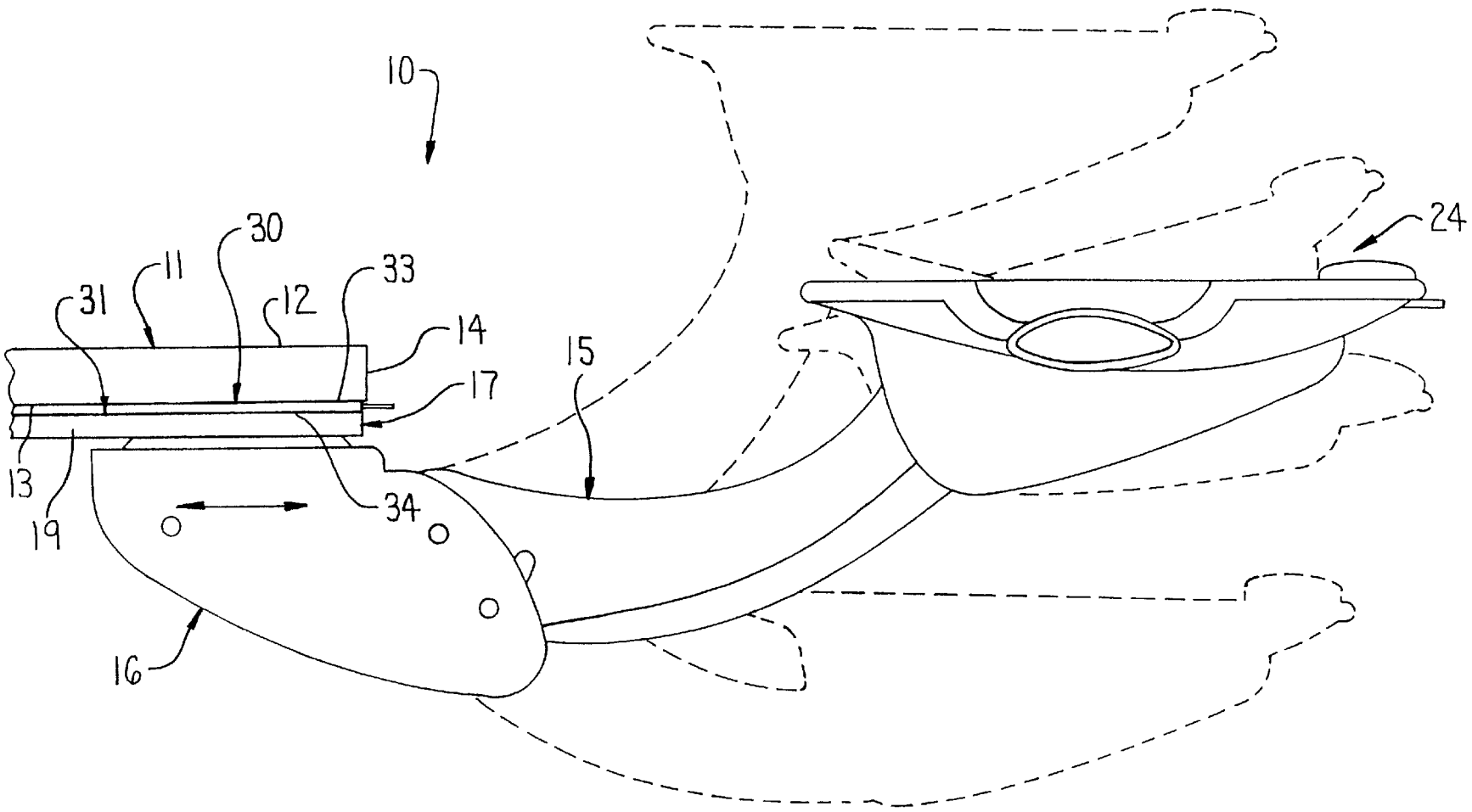
FIG. 3 is a fragmentary left side elevational view of the keyboard support arrangement and instruction card assembly of FIG. 1.

Referring to the drawings, and specifically FIGS. 1–3, there is illustrated an articulated keyboard support arrangement 10. The arrangement 10 is adapted to be mounted on a conventional worksurface or table top 11, the latter having generally horizontal and substantially planar upper and lower surfaces 12 and 13, respectively, with the worksurface 11 terminating at a free front edge 14.

Figure 6:
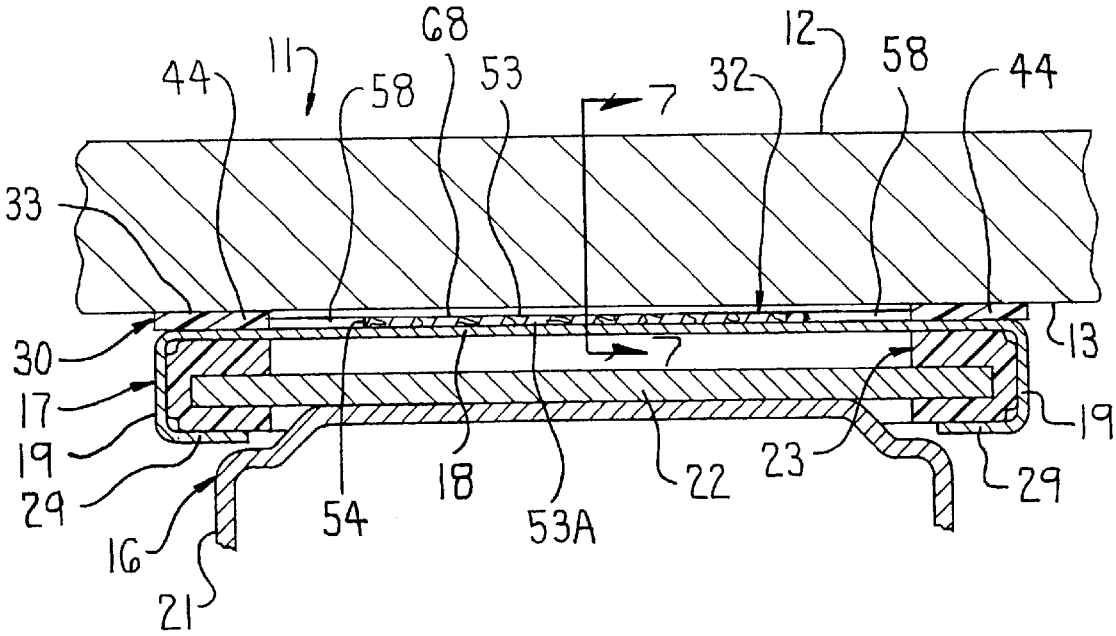
FIG. 6 is a fragmentary cross-sectional view taken generally along line 6—6 in FIG. 2 and with the instruction card in the retracted storage position.

The keyboard arrangement 10 includes an elongate support arm 15 which at the rear end thereof couples to a carriage 16 which is positionable under the worksurface 11 adjacent the lower surface 13 thereof. The carriage 16 is confined for sliding movement in a front-to-back direction of the worksurface 11 by an elongate track 17 stationarily and horizontally mounted on lower surface 13 of worksurface 11. The track 17, with reference to FIGS. 3 and 6, is mounted to lower surface 13 so as to extend transversely relative to front edge 14 and so that the forwardmost terminal end thereof is substantially vertically aligned or flush therewith. Track 17 is of a conventional construction and includes a flat top wall 18 and a pair of upright side walls 19 which depend downwardly from opposite longitudinal edges of top wall 18. A pair of generally horizontally oriented flanges 29 are cantilevered inwardly from the respective longitudinal lower edges of side walls 19.

The carriage 16 is embodied by a bracket 21 which is generally U-shaped in cross-section. Bracket 21 nonrotatably mounts on a top wall thereof a circular plate or disc 22. A frame-like slide arrangement 23 is mounted on disc 22 in a surrounding manner and is confined within track 17. More specifically, the frame-like slide arrangement 23 and disc 22 are slidably engaged within track 17 and to enable slidable movement of the keyboard support arrangement 10 relative to the worksurface 11 in a front-to-back direction of the worksurface 11 as indicated by the arrow in FIG. 3. Further, the configuration of frame-like slide arrangement 23 allows rotation of disc 22 therewithin about a vertical axis which permits the keyboard support arrangement 10 to be angularly displaceable relative to the worksurface 11.

The forward end of the support arm 15 mounts thereon a pad assembly 24 including a main support pad 25 and a reversible auxiliary support pad 26 for supporting a computer keyboard and a computer mouse respectively. The keyboard support arrangement 10 including the track 17 and carriage 16 is disclosed in application Ser. No. 09/174,000 and will not be discussed in further detail. The '000 application is owned by the same Assignee as the instant application, and is hereby incorporated by reference in its entirety herein.

Figure 4:
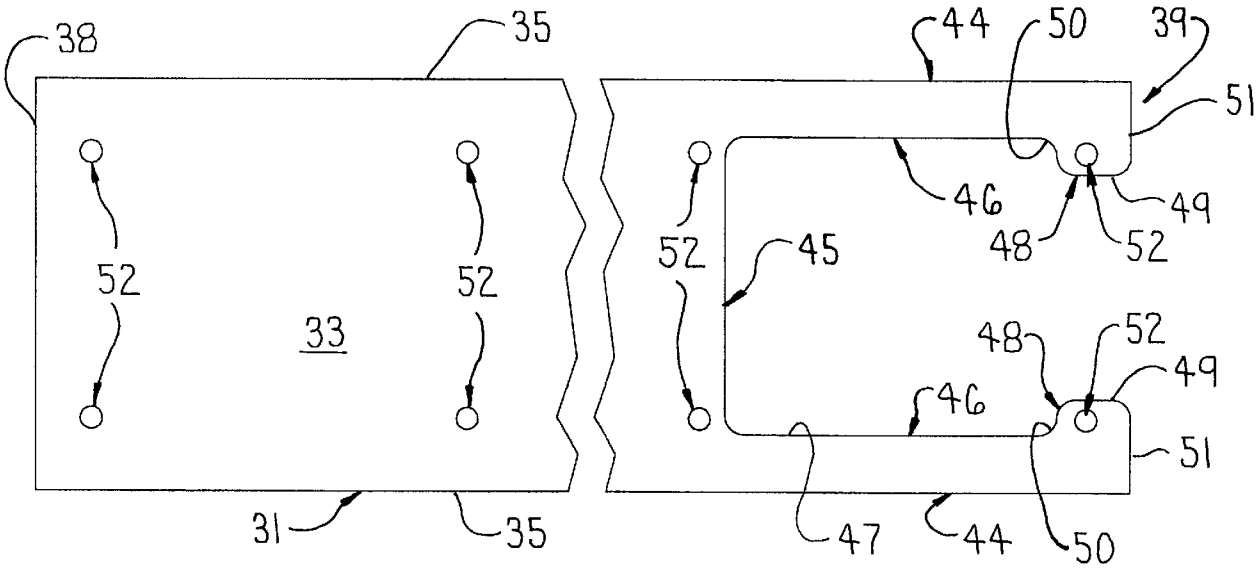
FIG. 4 is a fragmentary top view of the spacer plate of the instruction card assembly.
Figure 7:
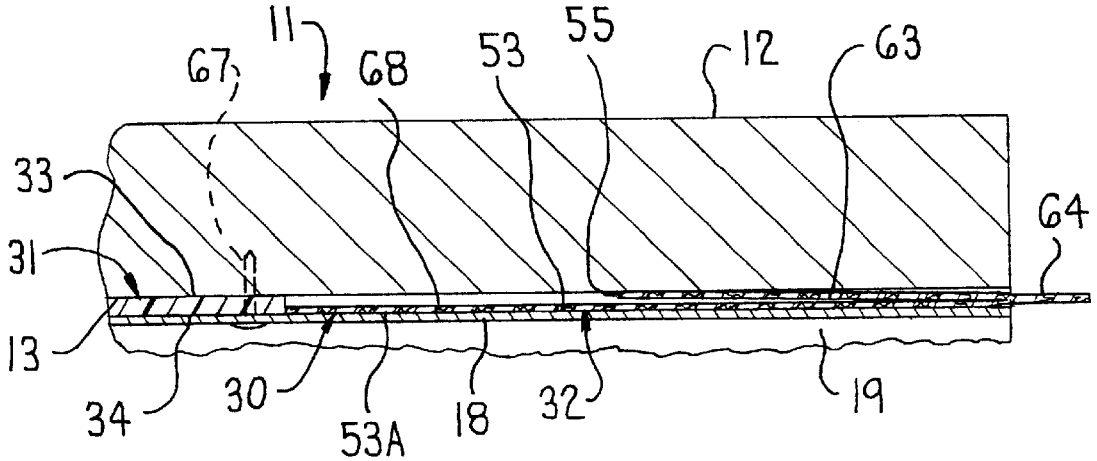
FIG. 7 is a fragmentary cross-sectional view taken generally along line 7—7 in FIG. 6 with the instruction card in the retracted storage position.

The keyboard support arrangement 10 incorporates therein an instruction card assembly 30 according to the present invention which is mounted adjacent the rear end of the support arm 15. Instruction card assembly 30 includes a rigid spacer plate 31 and an instruction card 32. With reference to FIGS. 4, 6 and 7, the spacer plate 31 is elongate in configuration and defines upper and lower generally planar surfaces 33 and 34, and a pair of generally parallel and straight longitudinal edges 35 which are joined to one another by a straight rear end edge 38. The front end 39 of spacer plate 31 is U-shaped and includes a pair of arms or legs 44 which are horizontally spaced from one another and cantilevered from an end edge 45 which is spaced forwardly from and generally parallel to rear end edge 38. The arms 44 define respective inner straight edges 46 which together with end edge 45 define a rearwardly projecting and frontwardly opening recess 47. Forwardmost ends 48 of arms 44 define opposed edges 49 which are spaced inwardly from and are generally parallel to the respective inner edges 46 such that a shoulder 50 is defined therewith. Edges 49 together define a mouth of recess 47 which is narrowed in relation to the rearward portion of recess 47. The forward ends 48 of the respective arms 44 terminate in front end edges 51 which are generally parallel to end edges 45 and 38 and define the forwardmost end of spacer plate 31. As shown in FIG. 4, multiple pairs of mounting holes 52 extend through the spacer plate 31. The frontmost pair of mounting holes 52 are disposed in the respective forward ends 48 of arms 44, and additional pairs of mounting holes 52 are located in a spaced apart fashion along the length of the spacer plate 31, with the individual holes of each pair of mounting holes 52 being positioned closely adjacent one of the longitudinal edges 35 of plate 31. Further, in the illustrated embodiment the longitudinal length of spacer plate 31 is the same as or similar to the longitudinal length of track 17 as measured in a front-to-back direction of the worksurface 11.

In the illustrated embodiment, the spacer plate 31 is constructed of a rigid plastic such as polystyrene or polypropylene, however, other materials may be utilized in accordance with the invention provided that same are of sufficient rigidity.

Figure 5:
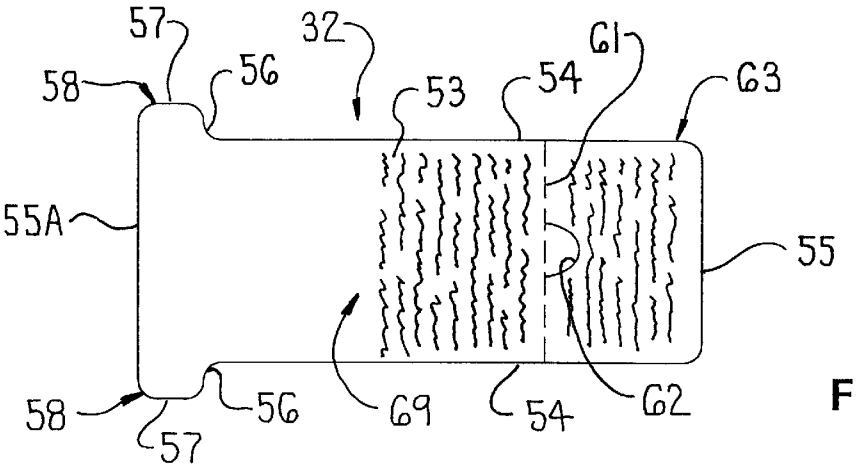
FIG. 5 is a top view of the instruction card of the instruction card assembly in an unfolded or flat configuration.

Turning now to card 32, and with reference to FIG. 5, same includes upper and lower generally planar surfaces 53 and 53A, a pair of generally parallel longitudinal edges 54 which are adjoined to one another by generally parallel front and rear end edges 55 and 55A. Each longitudinal edge 54 transitions into rear end edge 55A via respective shoulders 56 which then adjoin a straight edge 57 horizontally offset from, but parallel to, the respective longitudinal edge 54 to form a pair of lugs or stops 58. Stops 58 define the rear end portion of the card 32 and provide same with a generally T-shaped configuration when viewed from above or below.

Card 32, at the front end thereof, includes a pre-formed fold line 61 which extends between and is generally perpendicular to the respective longitudinal edges 54. Further, a semi-circular cut line 62 is defined in card 32 which terminates at fold line 61 such that when card 32 is folded along fold line 61, a flap 63 is formed which overlays or is superimposed on the upper surface 53 of the rear portion of card 32 and a semi-circular tab or handle 64 projects outwardly from card 32 as shown in FIGS. 2 and 7. In the illustrated embodiment, the upper surface 53 of card 32 is provided with printed and/or pictorial instructional information 69 as necessary for operation of the keyboard support arrangement 10. Further, as shown in FIG. 2, the lower surface 53A of flap 63 (which faces upwardly in the folded position of flap 63) may also be provided with printed and/or pictorial information so that a large amount of information can be provided on card 32, if necessary.

The card 32 in the illustrated embodiment is constructed of rigid paper material such as cardboard, however, other materials (such as plastic) may be utilized for card 32. It will appreciated that card 32 may also be formed without fold line 61 and flap 63, for example by providing front end edge 55 with a semi-circular outwardly-projecting tab.

With reference to FIGS. 2, 6 and 7, the instruction card assembly 30 according to the invention is installed on the keyboard support arrangement 10 as follows. Spacer plate 31 is positioned on the upper side of the top wall 18 of track 17 such that the longitudinal edges 35 are generally aligned with the side walls 19 of track 17, and so that the frontmost end edges 51 of arms 44 are aligned with one transverse terminal edge of track 17. For this purpose, a strip of double-sided adhesive tape (not shown) may be provided on the lower surface 34 of spacer plate 31 rearwardly of recess 47 and between the longitudinal edges 35 to temporarily position plate 31 relative to track 17. The card 32 with the flap 63 thereof being folded over so as to be superimposed on upper surface 53 thereof is then positioned within recess 47 so that the stops 58 are disposed behind the inwardly projecting forward ends 48 of arms 44 and so that the card 32 is supported atop the top wall 18 of track 17. It will be appreciated that the stops 58 of card 32 have a combined transverse dimension which is sized to permit the edges 57 thereof to slidably engage or lie closely adjacent the respective inner edges 46 of arms 44.

The track 17 and attached spacer plate 31 and card 32 are then positioned along the lower surface 13 of worksurface 11 so as to extend in a front-to-back direction thereof, and so that the end of the track 17 adjacent recess 47 of spacer plate 31 is positioned in vertical alignment with the front free edge 14 of worksurface 11 (as best illustrated in FIG. 3), and so that the card 32 is positioned closely adjacent lower surface 13 of worksurface 11. Fasteners 67 (only one of which is shown in FIG. 7 in dotted lines) such as screws, are then inserted upwardly through mounting holes (not shown) formed in the top wall 18 of track 17 (and vertically aligned with mounting holes 52 of spacer plate 31), through mounting holes 52 of spacer plate 31 and into the lower surface 13 of worksurface 11. The carriage 16 is then mounted on track 17 by slidably inserting the frame-like slide arrangement 23 sidewardly into the downwardly-opening channel defined by track 17.

With the spacer plate 31 and track 17 installed on the lower surface 13 of worksurface 11, the spacer plate 31 is thus sandwiched between the lower surface 13 and the top wall 18 of track 17 such that the upper side of top wall 18, the inner edges 46 of arms 44 of spacer plate 31, the end edge 45 of spacer plate 31, and the lower surface 31 of worksurface 11 together define a horizontally oriented narrow slot 68 which opens sidewardly and beneath the front free edge 14 of worksurface 11 and extends horizontally rearwardly thereof beneath lower surface 13. The card 32 is thus positioned and confined within this slot 68 as best shown in FIG. 7.

In the retracted or storage position of card 32 as shown in FIGS. 1, 3, 6 and 7 (and in dotted lines in FIG. 2), the tab or handle 64 projects horizontally outwardly beyond the front free edge 14 of the worksurface 11 and is easily accessible by the user. To view the instructions provided on card 32, the handle 64 is pulled outwardly with the fingers to move the card 32 into the extended position as shown in FIG. 2, and the flap 63 can then be unfolded to provide visual access to the instructions printed thereon. In this regard, removal of the card 32 from slot 68 is prevented by the abutment of the shoulders 56 of stops 58 of card 32 with the shoulders 50 formed on the forward ends 48 of arms 44. The card 32 is returned to the storage position simply by folding flap 63 over and pushing the card 32 inwardly into slot 68 whereby the stops 58 are located substantially adjacent the end edge 45 of spacer plate 31.

The instruction card assembly 30 according to the invention is easily assembled to the keyboard support arrangement 10 illustrated herein, and since many conventional keyboard supports utilize a channel-like track similar to track 17 for slidable mounting of the keyboard support to the worksurface 11, the assembly 30 may be utilized with other keyboard supports than that shown here, or retrofitted on existing keyboard supports without modifying the existing structure of the support. Further, the storability of the instruction card 32 under the worksurface 11 when not in use avoids excessive wear and tear on the card 32 which can lengthen the life and readability thereof.

It will be appreciated that the instruction card assembly 30 according to the invention may be utilized with any worksurface to provide convenient reference to instructional information pertaining to features of the worksurface itself, or other accessories. In this regard, instead of sandwiching spacer plate 31 between track 17 and the lower surface 13 of the worksurface 11, a flat plate-like member can be used in place of track 17 and fasteners can be inserted through this plate-like member, through spacer plate 31 and into worksurface 11. Thus, the instant invention is not limited to use with a keyboard support.

It will also be appreciated that the instant invention may also be configured as a carousel-type arrangement. More specifically, the spacer element disclosed herein may instead be provided with a generally semi-circular recess which opens sidewardly and in which a rigid circular disk is rotatably contained. The disk defines therein a plurality of radially oriented slots which open sidewardly and each receives therein an instruction card. The disk is then rotated to align one of the slots thereof with the recess of the spacer element and the respective card can then be pulled outwardly for reading the instructions thereon.

In addition, while the above embodiment of FIGS. 1–7 includes a card which is manually removed from the slot, the spacer element may instead be provided with a spring arm molded thereinto which cooperates with a release mechanism. The spring arm would serve to eject the card upon actuation of the release mechanism.

Further, the instruction card assembly according to the invention may also be provided with a locking mechanism which permits removal of the card only upon entry of the appropriate password.

Although a particular preferred embodiment of the present invention has been disclosed in detail for illustrative purposes, it will be recognized that variations or modifications of the disclosed apparatus, including the rearrangement of parts, lie within the scope of the present invention.

What is claimed is:

1. A keyboard support arrangement comprising:

a keyboard support defining an upper surface for supporting a computer keyboard thereon;

an elongate support arm having a front end connected to said keyboard support and a rear end connected to a worksurface by a mounting element secured to a lower surface of the worksurface; and an information card assembly disposed adjacent said rear end of said support arm between said mounting element and the lower surface of the worksurface, said assembly including a card having instructional information thereon and being movable between a retracted position wherein said card is positioned substantially beneath the worksurface and an extended position wherein the card projects horizontally beyond a terminal edge of the worksurface adjacent said keyboard support to provide the user with visual access to the instructional information.

2. The keyboard support arrangement of claim 1 wherein said information card assembly includes a spacer element disposed between an upper surface of said mounting element and the lower surface of the worksurface, said spacer element defining a sidewardly opening recess in which said card is slidably disposed.

3. The keyboard support arrangement of claim 1 further including a worksurface defining oppositely facing upper and lower surfaces thereon, said information card assembly including a spacer element clamped between an upper surface of said mounting element and said lower surface of said worksurface, said spacer element at least partially defining a sidewardly opening recess which receives therein said card, said card being slidably disposed within said recess and movable between said extended and retracted positions.

4. The keyboard support arrangement of claim 2 wherein one of said card and said spacer element includes a stop thereon which prevents removal of said card from said recess.

5. The keyboard support arrangement of claim 2 wherein said spacer element includes a pair of sidewardly-spaced legs which terminate in respective front ends which project inwardly towards one another and transversely relative to the elongated direction of said spacer element, said front ends defining a mouth of said recess which opens sidewardly and is spaced vertically downwardly from the terminal edge of the worksurface.

6. The keyboard support arrangement of claim 1 wherein said card defines therein a fold line extending transversely between respective longitudinal edges thereof, said card when folded along said fold line defining a flap which overlays an upper surface of said card in said retracted position and which is pivotable forwardly about said fold line in said extended position of said card to provide visual access to the instructional information thereon.

7. The keyboard support arrangement of claim 6 wherein said card includes a tab which is cantilevered sidewardly from said card adjacent said fold line such that said tab projects beyond the terminal edge of the worksurface in said retracted position of said card.

8. In a keyboard support arrangement having a support arm with a front end mounted to a computer keyboard support and a rear end slidably mounted to an elongate channel-shaped track fixed to the underside of a worksurface such that a terminal end of the track is disposed closely adjacent an edge portion of the worksurface, comprising the improvement wherein an information card assembly is provided adjacent the rear end of the support arm and includes a spacer element clamped between an upper surface of the track and the underside of the worksurface so as to space the track downwardly therefrom, said spacer element defining a slot which opens outwardly adjacent the edge portion of the worksurface, said information card assembly further including a card having instructional information thereon, said card being disposed within said slot for sliding movement between an extended position wherein said card is cantilevered outwardly from said slot adjacent an upper surface of the support arm for providing visual access to the instructional information and a retracted storage position wherein said card is positioned substantially beneath the worksurface to prevent damage thereto.

9. The keyboard support arrangement of claim 8 wherein said spacer element is elongate and has a rear edge portion spaced from the edge portion of the worksurface and a front edge portion positioned closely adjacent the edge portion of the worksurface, said front edge portion having a U-shaped configuration when viewed from above defined by a pair of legs which project forwardly from said rear edge portion of said spacer element and terminate in respective front ends which project inwardly towards one another and transversely relative to the elongated direction of the spacer element, said front ends defining a narrow mouth portion of said slot which opens sidewardly and is spaced vertically downwardly from the edge portion of the worksurface.

10. The keyboard support arrangement of claim 9 wherein said card includes a pair of stops thereon which respectively cooperate with said front ends of said spacer element in said extended position of said card to prevent removal of said card from said slot.

11. The keyboard support arrangement of claim 8 wherein said card defines therein a fold line extending transversely between respective longitudinal edges thereof, said card when folded along said fold line defining a flap which overlays an upper surface of said card in said retracted storage position and which is pivotable forwardly about said fold line in said extended position of said card to provide visual access to the instructional information printed thereon.

12. The keyboard support arrangement of claim 11 wherein in said retracted storage position of said card said flap overlays said upper surface of said card and is disposed within said slot, said card including a tab which is cantilevered sidewardly from said card adjacent said fold line thereof such that said tab projects horizontally beyond the edge portion of the worksurface in said retracted storage position of said card.

13. The keyboard support arrangement of claim 8 including a plurality of fastening elements which extend upwardly through a top wall of the track, through said spacer element and into the underside of the worksurface to secure said information card assembly to the worksurface.

14. A support pad arrangement for a computer keyboard, said arrangement comprising:

a keyboard support pad having a generally enlarged upper surface for supporting a computer keyboard thereon;

an elongate channel-shaped track fixed to a lower surface of a worksurface so as to be oriented in a front-to-back direction thereof, said track having a substantially planar top wall positioned closely adjacent the lower surface of the worksurface;

an elongate supporting structure having one end connected to said keyboard support pad and an opposite end slidably engaged within said track for permitting movement of said keyboard support pad towards and away from the worksurface; and an information card assembly sandwiched between said top wall of said track and the lower surface of the worksurface, said assembly including a plate-shaped element having an upper side facing the lower surface of the worksurface and a lower side facing the top wall of said track, said plate-shaped element defining a generally horizontally extending recess therein which opens sidewardly adjacent a terminal edge portion of the worksurface, and a card including instructional information thereon slidably disposed within said recess, said card being extendible outwardly from said recess for providing the user with visual access to the information thereon.

15. The support pad arrangement of claim 14 wherein said card mounts thereon on a handle member which projects horizontally beyond the terminal edge portion of the worksurface when said card is disposed in a fully retracted position so as to be disposed substantially beneath the worksurface.

16. The support pad arrangement of claim 15 wherein said plate-shaped element is generally planar and includes a front end portion disposed closely adjacent the terminal edge portion of the worksurface, said front end portion being generally U-shaped when viewed from above and defined by a pair of horizontally sidewardly spaced legs which are interconnected to one another by an edge wall of said plate-shaped element which extends transversely between said legs, said plate-shaped element being in direct contact with both said top wall and the lower surface of the worksurface such that inner edges of said legs, said edge wall, an upper surface of said top wall, and the lower surface of the worksurface together define said recess.

17. The support pad arrangement of claim 16 wherein said legs define respective front ends disposed closely adjacent the terminal edge portion of the worksurface, said front ends defining respective stops thereon which cooperate with correspondingly disposed stops of said card to limit the outward extension of said card from said recess.

18. The support pad arrangement of claim 17 wherein said stops of said card are cantilevered outwardly from opposite longitudinal edges thereof at one end of said card to provide said card with a T-shaped configuration, said stops of said plate-shaped element projecting inwardly towards one another from opposite longitudinal edges of said plate-shaped element for engagement with the respective said stops of said card in said extended position thereof to prevent removal of said card from said recess.

19. The support pad arrangement of claim 14 wherein said card when extended from said recess is spaced upwardly from said supporting structure and is extendible outwardly from said recess in a direction generally parallel to the elongated direction of said supporting structure.

20. The support pad arrangement of claim 14 wherein said card defines therein a fold line extending transversely between longitudinal edges thereof, said card when folded along said fold line defining a flap which overlays an upper sur,face of said card in a retracted storage position wherein said card is positioned substantially completely within said recess, said flap being pivotable forwardly about said fold line when said card is extended from said recess to provide visual access to information printed thereon.

* * * * *